US011406175B2

(12) United States Patent
Matsuura et al.

(10) Patent No.: US 11,406,175 B2
(45) Date of Patent: Aug. 9, 2022

(54) MAKEUP BRUSH

(71) Applicant: SHISEIDO COMPANY, LTD., Tokyo (JP)

(72) Inventors: Kazushi Matsuura, Yokohama (JP); Motoki Takata, Yokohama (JP); Miyako Okamoto, Tokyo (JP); Ai Nieda, Tokyo (JP); Mika Itou, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 271 days.

(21) Appl. No.: 16/625,489

(22) PCT Filed: Jul. 27, 2018

(86) PCT No.: PCT/JP2018/028264
§ 371 (c)(1),
(2) Date: Dec. 20, 2019

(87) PCT Pub. No.: WO2019/026793
PCT Pub. Date: Feb. 7, 2019

(65) Prior Publication Data

US 2021/0353040 A1 Nov. 18, 2021

(30) Foreign Application Priority Data

Jul. 31, 2017 (JP) ..... JP2017-147390

(51) Int. Cl.
*A46B 9/02* (2006.01)
*A45D 33/36* (2006.01)

(52) U.S. Cl.
CPC ..... *A46B 9/021* (2013.01); *A45D 33/36* (2013.01); *A46B 9/028* (2013.01); *A46B 2200/1046* (2013.01)

(58) Field of Classification Search
CPC ..... A46B 9/021; A46B 9/028; A45D 33/36
See application file for complete search history.

(56) References Cited

U.S. PATENT DOCUMENTS 6,779,532 B2 8/2004 Dorf
D768,998 S * 10/2016 Kim ..... D4/127
(Continued)

FOREIGN PATENT DOCUMENTS

CA 2922495 A1 3/2015
EP 1787545 A2 5/2007
(Continued)

OTHER PUBLICATIONS

International Search Report, International Application No. PCT/JP2018/028264 dated Oct. 9, 2018, 4 pages.

*Primary Examiner* — Shay Karls
(74) *Attorney, Agent, or Firm* — Rankin, Hill & Clark LLP

(57) ABSTRACT

[Problem] This invention provides a makeup brush that not only enables easy application of cosmetics such as blushers and eyeshadows while creating gradations, but also achieves a beautiful finish, without requiring special makeup techniques.

[Solution] A makeup brush 1, wherein an upper opening portion 2*a* of a cylindrical member 2 is formed into an arc shape having a predetermined width when planarly viewed, and a tip surface 3*a* of a brush 3 that is formed by tips of bristles extending upward from the upper opening portion of the cylindrical member is a composite curved surface having a first protruding curved surface 6 that is formed in such a manner that a length of brush bristles becomes gradually longer from an inner curved surface 4 having the arc shape toward an outer curved surface 5 having the arc shape, and a second protruding curved surface 7 that is formed in such a manner that the length of the brush bristles gradually
(Continued)

changes along a length direction of the arc shape and that the brush bristles are the longest at approximately a central portion.

5 Claims, 3 Drawing Sheets

(56) References Cited

U.S. PATENT DOCUMENTS

| | | | | |
|---|---|---|---|---|
| D837,531 | S * | 1/2019 | Hirokawa | D4/135 |
| 2007/0110501 | A1 | 5/2007 | Gueret | |
| 2014/0332027 | A1 | 11/2014 | Lim | |
| 2015/0083158 | A1 | 3/2015 | Abraham et al. | |
| 2016/0081456 | A1 | 3/2016 | Grund et al. | |
| 2017/0156473 | A1 | 6/2017 | Grund et al. | |
| 2017/0188691 | A1 | 7/2017 | Richards | |
| 2018/0125202 | A1 | 5/2018 | Abraham et al. | |

FOREIGN PATENT DOCUMENTS

| | | | |
|---|---|---|---|
| EP | 3048929 | A1 | 9/2018 |
| FR | 2893237 | A1 | 5/2007 |
| FR | 3024825 | A1 | 2/2016 |
| FR | 3026617 | A1 | 4/2016 |
| JP | 2003-81766 | A | 3/2003 |
| JP | 2007-136200 | A | 6/2007 |
| JP | 2014-113484 | A | 6/2014 |
| WO | 2015/042538 | A1 | 3/2015 |
| WO | 2016/137994 | A1 | 9/2016 |
| WO | 2018/011665 | A1 | 1/2018 |

* cited by examiner

MAKEUP BRUSH

TECHNICAL FIELD

The present invention relates to a makeup brush for applying cosmetic powder such as blushers and eyeshadows.

BACKGROUND ART

Since makeup brushes have conventionally been important makeup tools that affect the finish of makeup, there exist various types of makeup brushes according to the types of cosmetics, the areas of the parts to which the cosmetics are applied, and the like.

When applying cosmetic powder such as foundation or face powder, the cosmetic powder needs to be applied evenly to a relatively wide area of the face. For this reason, brushes that are in the shape of a paint brush or flat brushes are often used. Although brushes for applying blushers and eyeshadows are small since these brushes are applied to relatively small areas of the face, brushes of the same shape as the ones used for applying foundation and the like are commonly used for applying blushers and the like since blushers, too, are cosmetic powder as with foundation.

On the other hand, in order to achieve a beautiful finish of a blusher or eyeshadow, it is important to apply the blusher or eyeshadow to the skin while creating subtle gradations, which is largely attributed to the makeup techniques of the user. Therefore, it has not been easy for an ordinary user to achieve a beautiful finish using a conventional brush.

For this reason, it is important to develop makeup brushes that not only enable easy application of cosmetics such as blushers and eyeshadows while creating gradations, but also achieve a beautiful finish, without requiring special makeup techniques.

CITATION LIST

Patent Literature

[PTL 1] Japanese Patent Application Laid-open No. 2014-113484

SUMMARY OF INVENTION

Technical Problem

An object of the present invention is to provide a makeup brush that not only enables easy application of cosmetics such as blushers and eyeshadows while creating gradations, but also achieves a beautiful finish, without requiring special makeup techniques.

Solution to Problem

As a result of examinations by the inventor in order to achieve the foregoing object, the inventor has completed the present invention by discovering that, by forming a tip surface of a brush into a composite curved surface by combining a plurality of curved surfaces of predetermined shapes, a cosmetic such as a blusher and an eyeshadow can be applied easily while creating gradations, thereby achieving a beautiful finish.

Specifically, the present invention is a makeup brush wherein an upper opening portion of a cylindrical member is formed into an arc shape having a predetermined width when planarly viewed, and a tip surface of a brush that is formed by tips of bristles extending upward from the upper opening portion of the cylindrical member is a composite curved surface having a first protruding curved surface that is formed in such a manner that a length of brush bristles becomes gradually longer from an inner curved surface having the arc shape toward an outer curved surface having the arc shape, and a second protruding curved surface that is formed in such a manner that the length of the brush bristles gradually changes along a length direction of the arc shape and that the brush bristles are the longest at approximately a central portion.

Further, the present invention is a makeup brush wherein the upper opening portion of the cylindrical member is in the shape of an arc that has a curvature radius of 5 to 80 mm when planarly viewed.

Moreover, the present invention is a makeup brush wherein the first protruding curved surface has a curvature radius of 5 to 60 mm.

In addition, the present invention is a makeup brush wherein the second protruding curved surface has a curvature radius of 5 to 80 mm.

The present invention is also a cosmetic product obtained by combining the foregoing makeup brushes.

Advantageous Effects of Invention

According to the present invention, without requiring special makeup techniques, not only is it possible to achieve easy application of cosmetics such as blushers and eyeshadows while creating gradations, but also a beautiful finish can be realized.

DESCRIPTION OF EMBODIMENTS

Embodiments of the present invention are now described hereinafter with reference to the drawings.

Figure 1:
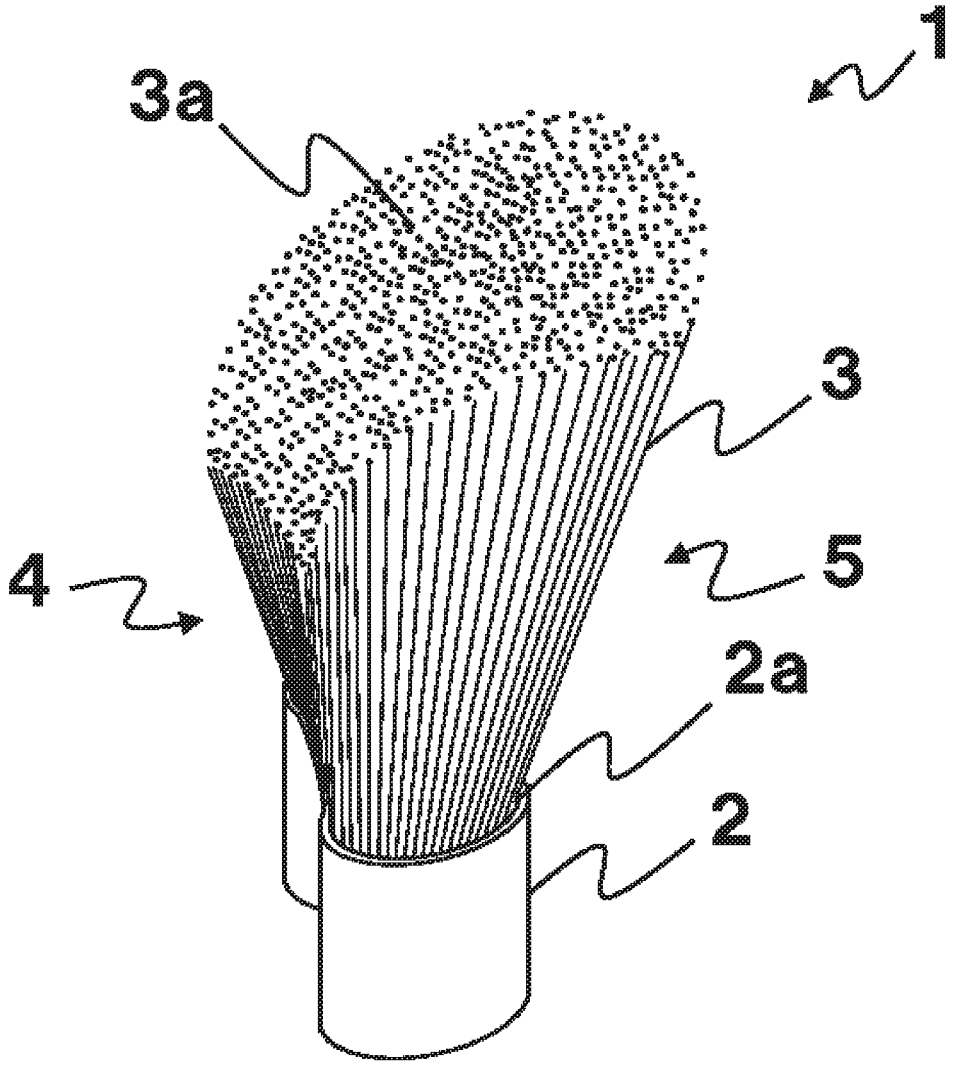
FIG. 1 is an external view of a makeup brush.

As shown in FIG. 1, in a makeup brush of the present invention, an upper opening portion (2*a*) of a cylindrical member (2) is formed into an arc having a predetermined width when viewed planarly, and bristles forming a brush (3) extend upward from the upper opening portion of the cylindrical member.

Figure 2:
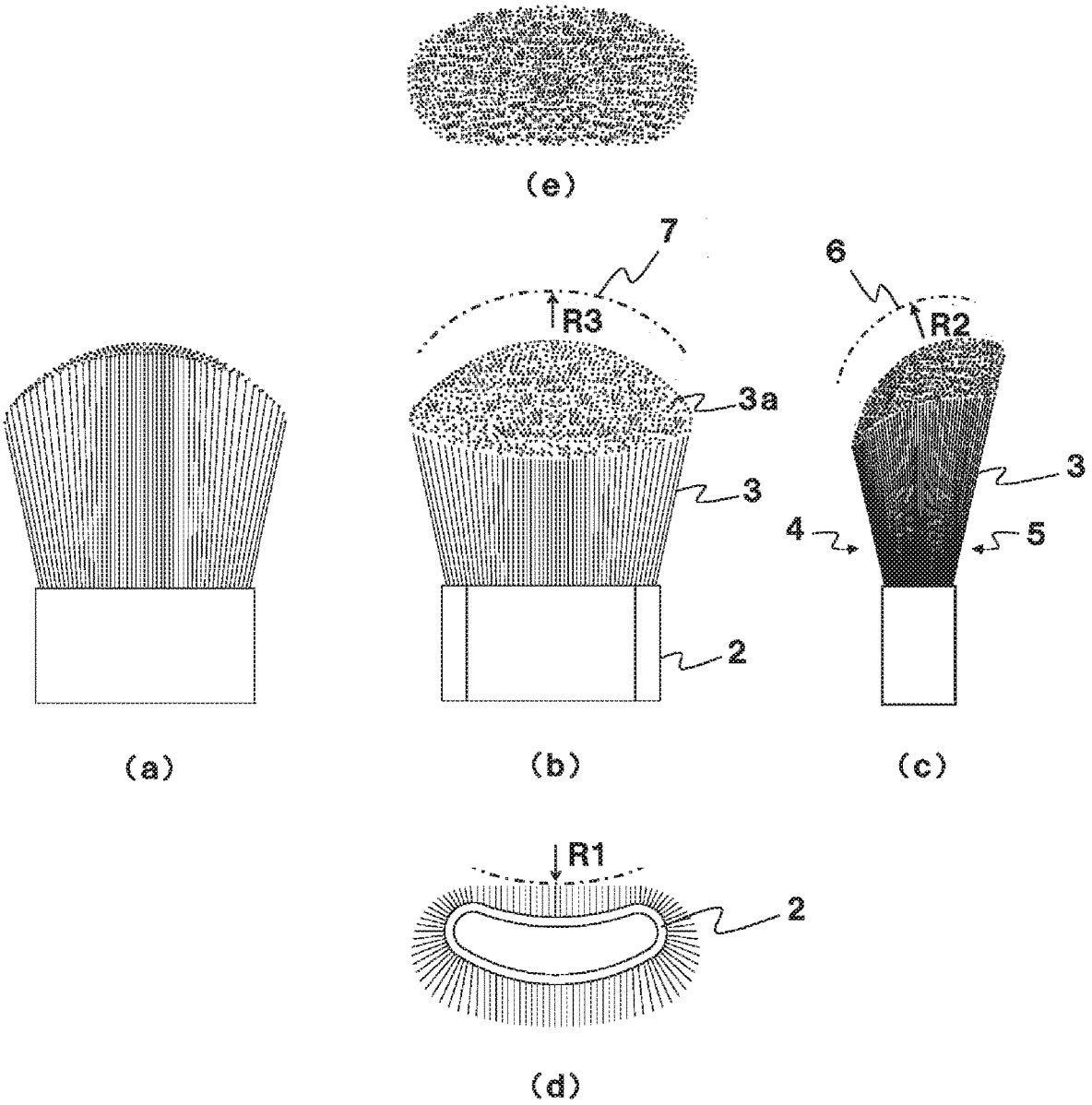
FIG. 2 is an external view of the makeup brush ((a) rear view, (b) front view, (c) side view, (d) bottom view, (e) plan view).

The bristles extending upward from the upper opening portion (2*a*) are shaped into an arc having the same curvature radius as the cylindrical member at a root section in the vicinity of the upper opening portion. As the bristles gradually expand upward, the curvature radius of the arc shape thereof gradually increases, and, depending on the length of the brush, a tip portion of the brush roughly becomes oval (FIG. 2). Such a brush (3) has arc-shaped inner curved surface (4) and outer curved surface (5) at least in the vicinity of the upper opening portion of the cylindrical member and slightly thereabove, and the curvature radiuses of both of these curved surfaces gradually increase from the root toward the tip.

The inner curved surface (4) of the brush (3) is shaped so as to easily come into tight contact with the skin, enabling smooth makeup application. Particularly, when a curvature radius R1 of the upper opening portion of the cylindrical member is set at 5 to 80 mm, an upper end portion of the inner curved surface can easily come into tight contact with the cheek, allowing a blusher or the like to be applied easily (FIG. 2(*d*)).

The cylindrical member (2) is a part to which the bristles constituting the brush are fixed. The cylindrical member is usually made from metal or resin, and the brush is formed by adhering and fixing the bristles to the inside of the cylindrical member. The cylindrical member can be used as-is as a handle of the makeup brush, gripped to apply makeup, or incorporated in a handle that is prepared separately from the cylindrical member.

When using the cylindrical member (2) as a handle of the makeup brush, it is preferred that a drum-shaped portion of the cylindrical member have the same arc shape as the upper opening portion. By forming the drum-shaped portion and the upper opening portion of the cylindrical member into the arc shape, the cylindrical member can easily come into tight contact with fingers when held, enabling easy makeup application. Especially by shaping the drum-shaped portion and the upper opening portion of the cylindrical member into arcs so that the curvature radius R1 is 5 to 80 mm, the inner curved surface can easily fit along the finger pad between the tip of a thumb and the first joint thereof, allowing the user to grip the makeup brush in such a manner that the brush is naturally perpendicular to the thumb and to perform makeup application more smoothly (FIG. 2).

A tip surface (3*a*) of the brush (3) has a first protruding curved surface (6) that is formed in such a manner that the length of brush bristles becomes gradually longer from the arc-shaped inner curved surface (4) to the arc-shaped outer curved surface (5) (FIG. 2(*c*)). A central portion of this first protruding curved surface (6) can easily come into contact with the center of a cheek, making it easy to determine a central position for performing makeup application. Especially by setting a curvature radius R2 of the first protruding curved surface (6) at 5 to 60 mm, not only is it possible to achieve excellent touch to the skin, but also a brusher and the like can be applied mainly to a predetermined position, with natural gradations, thereby obtaining excellent makeup effects.

The tip surface (3*a*) of the brush (3) also has a second protruding curved surface (7) that is formed in such a manner that the length of the brush bristles gradually changes along a length direction of the arc and that the brush bristles are the longest at approximately a central portion of the tip surface (FIG. 2(*b*)). When solid cosmetic powder such as a blusher is scooped by this second protruding curved surface (7), the cosmetic adheres to the center of the brush the most and less so on a periphery. Furthermore, the pressure at which the brush comes into contact with the skin is the strongest at the center of the brush and becomes weak toward the periphery. Therefore, natural gradations can easily be obtained by applying the cosmetic with the second protruding curved surface (7). Especially by setting a curvature radius R3 of the second protruding curved surface (7) at 5 to 80 mm, not only is it possible to achieve excellent touch to the skin, but also a brusher and the like can be applied while realizing natural gradations, thereby obtaining excellent makeup effects.

For the excellent touch to the skin and little interaction with ingredients contained in cosmetics, it is preferred that the material of the brush be one, two or more selected from polybutylene terephthalate, polyethylene terephthalate, polyethylene, polypropylene, polyamide, polymethyl methacrylate, horsehair, goat hair, squirrel hair, and hog hair.

Although not particularly limited, the length of the brush can be set at 5 to 50 mm so that excellent touch to the skin and smooth application of a blusher, an eyeshadow, or the like can be achieved.

The makeup brush can be stored in a compact container together with solid cosmetic powder such as a blusher, facilitating the portability of the makeup brush and enabling smooth makeup application on the go.

Figure 3:
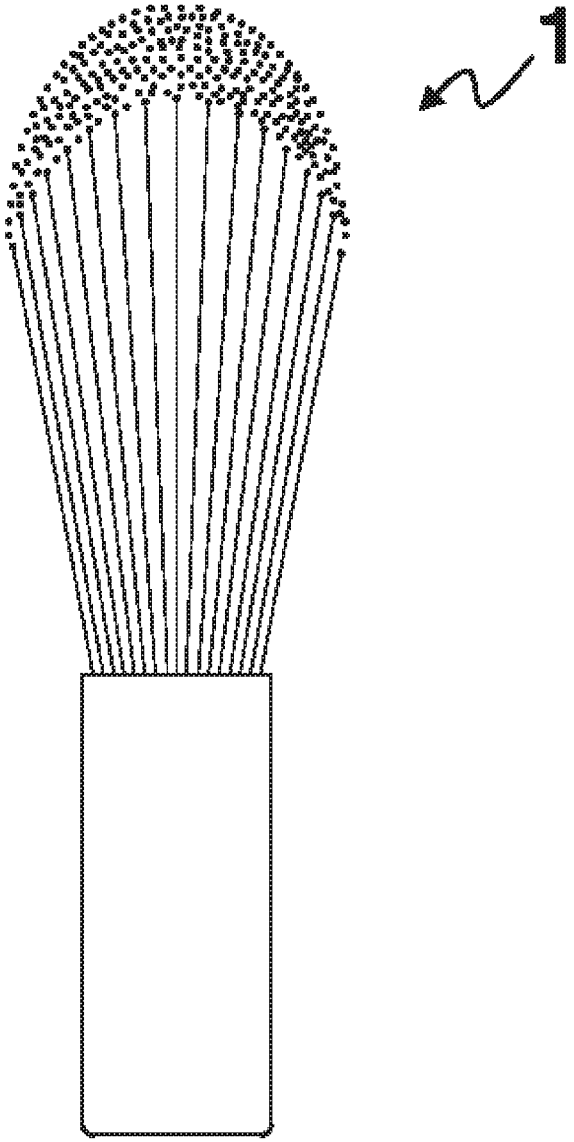
FIG. 3 is a front view of the makeup brush (other embodiment).

The size of the makeup brush can be adjusted as appropriate according to the part to which a cosmetic is applied. For example, when applying a cosmetic to a part having a relatively small area, such as applying an eyeshadow to an eyelid, it is preferred that the lateral width of the makeup brush be reduced as shown in FIG. 3, to achieve excellent makeup application. Note that the makeup brush of the present invention may be used not only to apply a blusher and an eyeshadow but also to apply foundation and white powder.

REFERENCE SIGNS LIST

1 Makeup brush
2 Cylindrical member
2*a* Upper opening portion
3 Brush
3*a* Tip surface
4 Inner curved surface
5 Outer curved surface
6 First protruding curved surface
7 Second protruding curved surface
R1 Curvature radius
R2 Curvature radius
R3 Curvature radius

The invention claimed is:

1. A makeup brush, wherein an upper opening and a lower end of a cylindrical member is formed into an arc shape having a predetermined width when planarly viewed, and a tip surface of a brush that is formed by tips of bristles extending upward from the upper opening of the cylindrical member is a composite curved surface having a first protruding curved surface that is formed in such a manner that a length of brush bristles becomes gradually longer from an inner curved surface having the arc shape toward an outer curved surface having the arc shape, and a second protruding curved surface that is formed in such a manner that the length of the brush bristles gradually changes along a length direction of the arc shape and that the brush bristles are the longest at approximately a central portion, the arc shape of the upper opening and the lower end comprises a first arc and a second arc, and the first arc and the second arc of the upper opening and lower end are concave in a same direction.

2. The makeup brush according to claim 1, wherein the upper opening of the cylindrical member is in the arc shape that has a curvature radius of 5 to 80 mm when planarly viewed.

3. The makeup brush according to claim 1, wherein the first protruding curved surface has a curvature radius of 5 to 60 mm.

4. The makeup brush according to claim 1, wherein the second protruding curved surface has a curvature radius of 5 to 80 mm.

5. A cosmetic product obtained by combining the makeup brushes of claim 1.

* * * * *